US007789933B2

(12) United States Patent
Tomizawa

(10) Patent No.: US 7,789,933 B2
(45) **Date of Patent: *Sep. 7, 2010**

(54) R-T-B BASED SINTERED MAGNET

(75) Inventor: Hiroyuki Tomizawa, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/562,336

(22) Filed: Sep. 18, 2009

(65) Prior Publication Data

US 2010/0008814 A1 Jan. 14, 2010

Related U.S. Application Data

(63) Continuation of application No. 12/132,738, filed on Jun. 4, 2008, now abandoned, which is a continuation of application No. PCT/JP2007/059384, filed on May 2, 2007.

(51) Int. Cl.
*H01F 1/08* (2006.01)
*H01F 1/057* (2006.01)
*C22C 29/14* (2006.01)

(52) U.S. Cl. ..... 75/244; 148/302

(58) Field of Classification Search ..... None
See application file for complete search history.

(56) References Cited

U.S. PATENT DOCUMENTS

| | | | | |
|---|---|---|---|---|
| 4,917,778 | A | 4/1990 | Takada et al. | |
| 2003/0098094 | A1 * | 5/2003 | Hasegawa et al. | 148/302 |
| 2006/0213584 | A1 * | 9/2006 | Nakamura et al. | 148/302 |

FOREIGN PATENT DOCUMENTS

EP 1 705 671 A2 9/2006

OTHER PUBLICATIONS

Tomizawa; "R-T-B Based Sintered Manet"; U.S. Appl. No. 12/132,738, filed Jun. 4, 2008.
Official Communication issued in corresponding European Patent Application No. 07742819.1, mailed on Jun. 18, 2009.
English translation of Official Communication issued in corresponding International Application PCT/JP2007/059384, mailed on Dec. 3, 2009.

* cited by examiner

*Primary Examiner*—John P Sheehan
(74) *Attorney, Agent, or Firm*—Keating & Bennett, LLP

(57) ABSTRACT

An R-T-B based sintered magnet according to the present invention comprises: 12 at % to 15 at % of a rare-earth element R; 5.0 at % to 8.0 at % of boron B; 0.02 at % to 0.2 at % of Mn; and a transition metal T as the balance. The rare-earth element R is at least one element selected from the rare-earth elements, including Y (yttrium), and includes 0.2 at % to 8 at % of Pr. And the transition element T includes Fe as its main element.

6 Claims, 4 Drawing Sheets

*FIG.4*

[mass%]

| | CHEMICAL SYMBOLS | | | | | | | | | | | | | | | | |
|---|---|---|---|---|---|---|---|---|---|---|---|---|---|---|---|---|---|
| No. | Pr | Nd | Tb | Dy | Fe | Co | Mn | Cr | Ni | Cu | Al | Ga | Zr | B | C | N | O |
| 1 | 2.50 | 28.50 | | | 66.9 | | 0.02 | 0.00 | 0.00 | 0.00 | 0.01 | | | 0.98 | 0.038 | 0.003 | 0.430 |
| 2 | 2.60 | 28.30 | | | 66.9 | | 0.02 | 0.00 | 0.00 | 0.00 | 0.30 | | | 0.98 | 0.040 | 0.003 | 0.420 |
| 3 | 2.50 | 28.50 | | | 66.7 | | 0.02 | 0.00 | 0.00 | 0.15 | 0.03 | | | 0.98 | 0.038 | 0.003 | 0.430 |
| 4 | 5.30 | 25.00 | | | 67.2 | | 0.05 | 0.00 | 0.00 | 0.10 | 0.20 | | | 0.99 | 0.042 | 0.002 | 0.410 |
| 5 | 8.00 | 23.10 | | | 62.0 | 3.10 | 0.04 | 0.00 | 0.00 | 0.10 | 0.25 | | | 0.98 | 0.039 | 0.002 | 0.440 |
| 6 | 7.45 | 22.30 | | | 62.0 | 3.50 | 0.08 | 0.01 | 0.00 | 0.10 | 0.24 | | | 0.98 | 0.051 | 0.003 | 0.190 |
| 7 | 5.50 | 22.40 | | 1.60 | 66.7 | 1.50 | 0.06 | 0.01 | 0.01 | 0.08 | 0.22 | 0.05 | | 0.95 | 0.043 | 0.003 | 0.180 |
| 8 | 3.50 | 24.50 | | 1.55 | 66.8 | 1.50 | 0.18 | 0.00 | 0.01 | 0.09 | 0.24 | 0.05 | 0.05 | 0.95 | 0.041 | 0.003 | 0.170 |
| 9 | 11.20 | 14.90 | | 5.00 | 64.8 | 2.00 | 0.15 | 0.01 | 0.00 | 0.11 | 0.24 | | | 0.98 | 0.031 | 0.002 | 0.450 |
| 10 | 15.00 | 11.20 | | 4.95 | 64.7 | 2.00 | 0.14 | 0.00 | 0.01 | 0.09 | 0.22 | | | 1.00 | 0.029 | 0.002 | 0.430 |
| 11 | 12.60 | 15.90 | 1.05 | | 66.1 | 2.00 | 0.12 | 0.01 | 0.00 | 0.13 | 0.24 | | | 0.99 | 0.052 | 0.003 | 0.180 |
| 12 | 10.20 | 15.10 | 1.00 | 3.15 | 66.0 | 2.00 | 0.09 | 0.01 | 0.01 | 0.15 | 0.25 | | | 0.98 | 0.049 | 0.003 | 0.170 |
| 13 | 2.50 | 28.50 | | | 66.7 | | 0.01 | 0.00 | 0.00 | 0.01 | 0.04 | | | 0.99 | 0.036 | 0.002 | 0.420 |
| 14 | 5.20 | 25.00 | | | 67.6 | | 0.01 | 0.00 | 0.00 | 0.10 | 0.20 | | | 0.98 | 0.040 | 0.002 | 0.440 |
| 15 | 8.00 | 23.10 | | | 62.0 | 3.10 | 0.01 | 0.00 | 0.00 | 0.10 | 0.23 | | | 0.99 | 0.039 | 0.002 | 0.440 |
| 16 | 11.20 | 14.90 | | 5.00 | 64.9 | 2.00 | 0.00 | 0.01 | 0.00 | 0.11 | 0.24 | | | 0.98 | 0.031 | 0.002 | 0.450 |
| 17 | 12.60 | 15.90 | 1.05 | | 66.1 | 2.00 | 0.01 | 0.01 | 0.00 | 0.13 | 0.24 | | | 0.99 | 0.052 | 0.003 | 0.180 |
| 18 | 10.20 | 15.10 | 1.00 | 3.15 | 66.5 | 2.00 | 0.00 | 0.01 | 0.01 | 0.15 | 0.25 | | | 0.98 | 0.049 | 0.003 | 0.170 |
| 19 | | 30.70 | | | 67.1 | | 0.05 | 0.00 | 0.00 | 0.10 | 0.22 | | | 0.99 | 0.042 | 0.003 | 0.420 |
| 20 | 31.10 | | | | 67.0 | | 0.05 | 0.01 | 0.00 | 0.10 | 0.20 | | | 0.98 | 0.040 | 0.002 | 0.450 |

*FIG.5*

[at%]

| | CHEMICAL SYMBOLS | | | | | | | | | | | | | | | | |
|---|---|---|---|---|---|---|---|---|---|---|---|---|---|---|---|---|---|
| No. | Pr | Nd | Tb | Dy | Fe | Co | Mn | Cr | Ni | Cu | Al | Ga | Zr | B | C | N | O |
| 1 | 1.16 | 12.87 | 0.00 | 0.00 | 78.05 | 0.00 | 0.02 | 0.00 | 0.00 | 0.00 | 0.02 | 0.00 | 0.00 | 5.91 | 0.21 | 0.014 | 1.75 |
| 2 | 1.19 | 12.70 | 0.00 | 0.00 | 77.56 | 0.00 | 0.02 | 0.00 | 0.00 | 0.00 | 0.72 | 0.00 | 0.00 | 5.87 | 0.22 | 0.014 | 1.70 |
| 3 | 1.16 | 12.88 | 0.00 | 0.00 | 77.84 | 0.00 | 0.02 | 0.00 | 0.00 | 0.15 | 0.07 | 0.00 | 0.00 | 5.91 | 0.21 | 0.014 | 1.75 |
| 4 | 2.43 | 11.22 | 0.00 | 0.00 | 77.89 | 0.00 | 0.06 | 0.00 | 0.00 | 0.10 | 0.48 | 0.00 | 0.00 | 5.93 | 0.23 | 0.009 | 1.66 |
| 5 | 3.75 | 10.59 | 0.00 | 0.00 | 73.39 | 3.48 | 0.05 | 0.00 | 0.00 | 0.10 | 0.61 | 0.00 | 0.00 | 5.99 | 0.21 | 0.009 | 1.82 |
| 6 | 3.53 | 10.33 | 0.00 | 0.00 | 74.20 | 3.97 | 0.10 | 0.01 | 0.00 | 0.11 | 0.59 | 0.00 | 0.00 | 6.06 | 0.28 | 0.014 | 0.79 |
| 7 | 2.54 | 10.09 | 0.00 | 0.64 | 77.63 | 1.65 | 0.07 | 0.01 | 0.01 | 0.08 | 0.53 | 0.05 | 0.00 | 5.71 | 0.23 | 0.014 | 0.73 |
| 8 | 1.61 | 11.01 | 0.00 | 0.62 | 77.52 | 1.65 | 0.21 | 0.00 | 0.01 | 0.09 | 0.58 | 0.05 | 0.04 | 5.69 | 0.22 | 0.014 | 0.69 |
| 9 | 5.15 | 6.70 | 0.00 | 1.99 | 75.21 | 2.20 | 0.18 | 0.01 | 0.00 | 0.11 | 0.58 | 0.00 | 0.00 | 5.88 | 0.17 | 0.009 | 1.82 |
| 10 | 6.91 | 5.04 | 0.00 | 1.98 | 75.17 | 2.20 | 0.17 | 0.00 | 0.01 | 0.09 | 0.53 | 0.00 | 0.00 | 6.00 | 0.16 | 0.009 | 1.74 |
| 11 | 5.79 | 7.14 | 0.43 | 0.00 | 76.63 | 2.20 | 0.14 | 0.01 | 0.00 | 0.13 | 0.58 | 0.00 | 0.00 | 5.93 | 0.28 | 0.014 | 0.73 |
| 12 | 4.71 | 6.81 | 0.41 | 1.26 | 76.86 | 2.21 | 0.11 | 0.01 | 0.01 | 0.15 | 0.60 | 0.00 | 0.00 | 5.89 | 0.27 | 0.014 | 0.69 |
| 13 | 1.16 | 12.89 | 0.00 | 0.00 | 77.94 | 0.00 | 0.01 | 0.00 | 0.00 | 0.01 | 0.10 | 0.00 | 0.00 | 5.98 | 0.20 | 0.009 | 1.71 |
| 14 | 2.38 | 11.17 | 0.00 | 0.00 | 78.02 | 0.00 | 0.01 | 0.00 | 0.00 | 0.10 | 0.48 | 0.00 | 0.00 | 5.84 | 0.21 | 0.009 | 1.77 |
| 15 | 3.75 | 10.59 | 0.00 | 0.00 | 73.40 | 3.48 | 0.01 | 0.00 | 0.00 | 0.10 | 0.56 | 0.00 | 0.00 | 6.05 | 0.21 | 0.009 | 1.82 |
| 16 | 5.15 | 6.70 | 0.00 | 2.00 | 75.37 | 2.20 | 0.00 | 0.01 | 0.00 | 0.11 | 0.58 | 0.00 | 0.00 | 5.88 | 0.17 | 0.009 | 1.82 |
| 17 | 5.80 | 7.15 | 0.43 | 0.00 | 76.73 | 2.20 | 0.01 | 0.01 | 0.00 | 0.13 | 0.58 | 0.00 | 0.00 | 5.94 | 0.28 | 0.014 | 0.73 |
| 18 | 4.69 | 6.78 | 0.41 | 1.25 | 77.07 | 2.20 | 0.00 | 0.01 | 0.01 | 0.15 | 0.60 | 0.00 | 0.00 | 5.87 | 0.26 | 0.014 | 0.69 |
| 19 | 0.00 | 13.76 | 0.00 | 0.00 | 77.69 | 0.00 | 0.06 | 0.00 | 0.00 | 0.10 | 0.53 | 0.00 | 0.00 | 5.92 | 0.23 | 0.014 | 1.70 |
| 20 | 14.21 | 0.00 | 0.00 | 0.00 | 77.26 | 0.00 | 0.06 | 0.01 | 0.00 | 0.10 | 0.48 | 0.00 | 0.00 | 5.84 | 0.21 | 0.009 | 1.81 |

R-T-B BASED SINTERED MAGNET

This application is a continuation application of U.S. application Ser. No. 12/132,738 filed on Jun. 4, 2008, which is a continuation of International Application No. PCT/JP2007/059384, with an international filing date of May 2, 2007.

BACKGROUND OF THE INVENTION

1. Field of the Invention

The present invention relates to an R-T-B (rare-earth-iron-boron) based sintered magnet.

2. Description of the Related Art

R-T-B based sintered magnets have so good magnetic properties as to find a wide variety of applications including various types of motors and actuators and are now one of indispensable materials for the electronics industry. Also, their applications have been appreciably broadened to keep up with the recent trend toward energy saving.

Lately, however, those motors and actuators are more and more often required to exhibit much higher performance than conventional ones in their rapidly expanding applications including motors for driving, or generating electricity for, hybrid cars or motors for hoisting elevators. And their requirements are becoming increasingly severe nowadays.

One of the old drawbacks of R-T-B based magnets is their relative low Curie temperature of approximately 300° C., at which their ferromagnetism is lost. And irreversible flux loss will occur easily in R-T-B based magnets. To overcome such a problem, various measures have been taken. For example, some people tried to increase the coercivity of the R-T-B based magnets by adjusting the combination of rare-earth elements to add. Other people attempted to increase the Curie temperature by adding Co as disclosed in Patent Document No. 1.

Several methods for increasing the coercivity have been proposed so far.

One of those methods is disclosed in Patent Document No. 2, in which heavy rare-earth elements such as Dy and Tb are included in particular percentages in the rare-earth elements. In practice, only Dy and Tb turned out to be effective enough. This method is adopted in order to increase the coercivity of the magnet as a whole, as well as the anisotropic magnetic field of its main phase that determines its magnetic properties.

Another method is disclosed in Patent Documents Nos. 3 and 4, for example, in which the coercivity is increased by introducing an additive element such as Al, Ga, Sn, Cu or Ag. It is not yet quite clear exactly how these elements can increase the coercivity. Nevertheless, it is at least known that the coercivity can be increased by changing the physical properties of a grain boundary phase (which is a so-called "R-rich phase") such as its wettability with the main phase in a high temperature range and eventually changing the microstructures with the addition of those elements.

Furthermore, the additive elements such as Ti, V, Cr, Zr, Nb, Mo, Hf and W disclosed in Patent Document No. 5, for example, hinder the growth of crystal grains during the sintering process and reduce the size of the resultant metallurgical structure of the sintered body, thus contributing to increasing the coercivity.

As for the selection of rare-earth elements, Non-Patent Document No. 1, for example, discloses magnetic properties that an $R_2Fe_{14}B$ compound would have with various rare-earth elements, and the composition can be determined by reference to such data. For example, the anisotropic magnetic field generated by Pr has temperature dependence, which is heavier than that of Nd. For that reason, even though Pr could increase the coercivity at room temperature, the coercivity to be exhibited by the additive Pr would rather be lower than that to be exhibited by Nd in a temperature range exceeding 80° C. That is why the addition of Pr would be counteractive at least in terms of thermal resistance.

Among these methods, the method that uses heavy rare-earth elements is most effective because the decrease in magnetic flux density is relatively small according to that method. According to any of the other methods mentioned above, however, a significant decrease in the magnetic flux density of the magnet is inevitable. And those methods are applicable to only a narrow field. For that reason, in making magnets actually, these techniques are used in an appropriate combination.

Patent Document No. 1: Japanese Patent Application Laid-Open Publication No. 59-64733

Patent Document No. 2: Japanese Patent Application Laid-Open Publication No. 60-34005

Patent Document No. 3: Japanese Patent Application Laid-Open Publication No. 59-89401

Patent Document No. 4: Japanese Patent Application Laid-Open Publication No. 64-7503

Patent Document No. 5: Japanese Patent Application Laid-Open Publication No. 62-23960

Non-Patent Document No. 1: S. Hirosawa et al., Magnetization and Magnetic Anisotropy of $Nd_2Fe_{14}B$ Measured on Single Crystals, J. Appl. Phys., 59 (1986), pp. 873-879

However, those heavy rare-earth elements such as Dy and Tb are among the rarest and expensive ones of all rare-earth elements. For that reason, if a lot of such heavy rare-earth elements should be used, then the price of the magnets would rise. In addition, as the applications of such R-T-B based sintered magnet have been rapidly expanding these days, resource-related restrictions on those heavy rare-earth elements have become an issue these days because those rare elements are available only in very limited quantities and in very narrow areas.

Also, as mentioned above, none of those methods is so effective by itself and each of them would generally result in a significant decrease in the magnetic flux density of the magnet. That is why it has been very difficult to increase the coercivity without using any heavy rare-earth element.

Thus, an object of the present invention is to provide a means for increasing the coercivity that would work independently of the effects caused by a heavy rare-earth element such as Dy or Tb.

SUMMARY OF THE INVENTION

An R-T-B based sintered magnet according to the present invention comprises: 12 at % to 17 at % of a rare-earth element R; 5.0 at % to 8.0 at % of boron B; 0.02 at % to 0.2 at % of Mn; and a transition metal T as the balance. The rare-earth element R is at least one element selected from the rare-earth elements, including Y (yttrium), and includes 0.2 at % to 8 at % of Pr. And the transition element T includes Fe as its main element.

In one preferred embodiment, the magnet includes at least one of Tb and Dy as the rare-earth element R.

In another preferred embodiment, the magnet includes 20 at % or less of Co as the transition metal T.

An R-T-M-B based sintered magnet according to the present invention comprises: 12 at % to 17 at % of a rare-earth element R; 5.0 at % to 8.0 at % of boron B; 0.02 at % to 0.2 at % of Mn; more than 0 at % to 5.0 at % of an additive element M; and a transition metal T as the balance. The rare-earth element R is at least one element selected from the rare-earth elements, including Y (yttrium), and includes 0.2 at % to 8 at % of Pr. The transition element T includes Fe as its main element. The additive element M is at least one element selected from the group consisting of Al, Ni, Cu, Zn, Ga, Ag, In, Sn, Bi, Ti, V, Cr, Zr, Nb, Mo, Hf, Ta and W.

In one preferred embodiment, the magnet includes at least one of Tb and Dy as the rare-earth element R.

In another preferred embodiment, the magnet includes 20 at % or less of Co as the transition metal T.

If an R-T-B based sintered magnet includes Pr as an essential element and an additive Mn in an amount that falls within a predetermined range, its coercivity at around room temperature can be increased and higher coercivity than conventional magnets' can be achieved even at high temperatures of 80° C. or more. Also, by adding a predetermined amount of Mn, the sintering reaction can be promoted during the manufacturing process of the sintered magnet. As a result, the sintering process can be done either at a lower temperature or in a shorter time and the sintered magnet can have a homogenized structure. Consequently, the loop squareness of the demagnetization curve can be improved as well.

BRIEF DESCRIPTION OF THE DRAWINGS

FIG. 4 is a table showing compositions as specific examples of the present invention and comparative samples.

FIG. 5 is a table showing compositions as specific examples of the present invention and comparative samples.

DETAILED DESCRIPTION OF PREFERRED EMBODIMENTS

Figure 1:
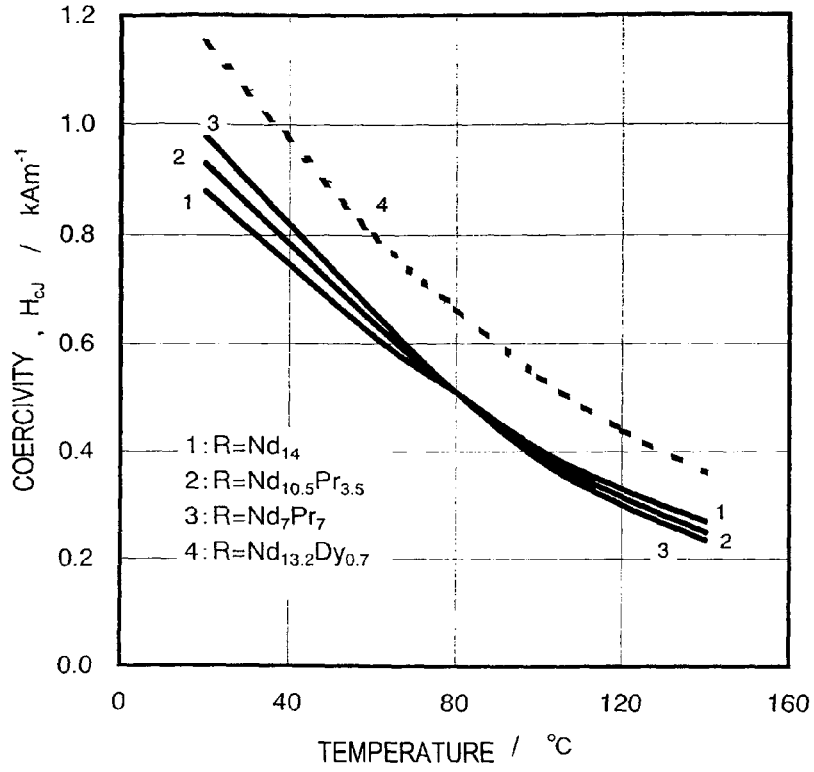
FIG. 1 is a graph showing how the coercivity of an R-T-B based sintered magnet changed with the temperature in a situation where rare-earth elements R were added in various combinations.

The present inventors discovered that by using Pr as one of the rare-earth elements and adding Mn to the composition of a magnet, its coercivity at room temperature could be increased and the decrease in coercivity at high temperatures of 80° C. or more, which would otherwise be caused in a conventional magnet with Pr, could be minimized.

An R-T-B based sintered magnet according to the present invention has a composition including: 12 at % to 17 at % of a rare-earth element R; 5.0 at % to 8.0 at % of boron B; 0.02 at % to 0.3 at % of Mn; and a transition metal T as the balance.

The rare-earth element R is at least one element selected from the rare-earth elements, including Y (yttrium), and includes 0.2 at % to 10 at % of Pr. The transition element T includes Fe as its main element.

Optionally, to achieve various effects, at least one element selected from the group consisting of Ni, Cu, Zn, Ga, Ag, In, Sn, Bi, Ti, V, Cr, Zr, Nb, Mo, Hf, Ta and W may be added as the additive element M.

In the prior art, the effects caused by the addition of Mn have been believed to be negative ones. That is to say, it has been believed that the additive Mn would deteriorate all major magnetic properties including the Curie temperature, anisotropic magnetic field and magnetization. Meanwhile, the effects of Pr have been researched from various angles in terms of the physical properties of a $Pr_2Fe_{14}B$ compound, for example. It is already well known in the art that Pr generates a greater anisotropic magnetic field than that of Nd at around room temperature, but that their relation reverses in the vicinity of 80° C., and that the magnetization produced by Pr is somewhat smaller than that produced by Nd.

However, it is virtually unknown what effects would be caused if Pr and Mn are added in combination. That is to say, a magnet including an $Nd_2Fe_{14}B$ phase as a main phase would have decreased coercivity and decreased magnetization if Fe were partially replaced with Mn. However, the present inventors discovered that by using the technique described above to substitute Pr for a portion of Nd, the coercivity could be increased. Also, this technique should work quite independently of any known means for increasing the coercivity.

Composition

The element of rare-earth element(s) according to the present invention is one of the most important factors to achieve the effects of the present invention. In general, to achieve the high performance of an R-T-B based sintered magnet, Nd is an indispensable element. According to the present invention, R includes Nd as an essential element and a predetermined amount of R is added thereto in order to increase the coercivity.

If Pr were added in less than the predetermined amount, the effects of the present invention could not be achieved. Besides, the addition of Mn, which is another essential element according to the present invention, would decrease both magnetization and coercivity alike. However, if Pr were added in more than the predetermined amount, the remanence would decrease more significantly and the coercivity would decrease even more steeply at temperatures higher than 100° C. Also, if Pr added exceeded the predetermined amount, a lot of Mn should be added to increase the coercivity. However, the effect would be counteracted because the addition of Mn itself would lead to a decrease in coercivity.

The lower limit of a preferred composition range for Pr is 0.2 at %, more preferably 0.5 at %. The upper limit of the Pr range is preferably 10 at %, more preferably 8.0 at %.

As long as it falls within the predetermined range to be defined below, the higher the mole fraction of R, the higher the coercivity and the smaller the remanence tend to be. Specifically, if the mole fraction of R were less than 12 at %, the percentage of the $R_2T_{14}B$ compound as the main phase would decrease, soft magnetic phases such as Fe would produce instead, and the coercivity would decrease significantly. On the other hand, if the mole fraction of R exceeded 17 at %, the percentage of the $R_2T_{14}B$ compound as the main phase would decrease and the magnetization would drop. In addition, since excessive R would be concentrated as metal elements in the grain boundary of the main phase, and the anticorrosiveness might decrease significantly. For these reasons, the mole fraction of R is preferably 12 at % to 17 at %, more preferably 12.5 at % to 15 at %.

One heavy rare-earth element or two such as Tb or Dy, which would contribute to increasing the coercivity, may be added depending on the required level of magnetic properties (or the coercivity, among other things) because it would not counteract the effect of the present invention. However, if the total mole fraction of the substituent(s) Tb and/or Dy exceeded 6 at %, the resultant remanence would be lower than 1.1 T. In addition, considering its applications under high-temperature environments, in particular, the performance of the R-T-B based sintered magnet should be rather lower than that of an Sm—Co magnet. On top of that, if a lot of Tb and/or Dy were used, then the material cost of the magnet would be too high to maintain its advantage over the Sm—Co magnet. In view of these considerations, the mole fraction of Tb and/or Dy is preferably 6 at % or less to achieve good industrial applicability. Meanwhile, the other rare-earth elements, including Y, could also be included as inevitably contained impurities, although they would not produce any benefits as far as magnetic properties are concerned.

Boron is an essential element to make an R-T-B based sintered magnet. The volume of the $R_2T_{14}B$ compound as the main phase is determined by that of boron. To achieve large magnetization while holding sufficient coercivity for the sintered magnet, the mole fraction of B is important. As long as it falls within the predetermined range to be defined below, the greater the mole fraction of B, the more easily sufficient coercivity could be achieved. Also, if the mole fraction of B were small, the coercivity would decrease steeply at a certain mole fraction of B. For that reason, from an industrial standpoint, it is particularly important to prevent the mole fraction of B from being short of that certain mole fraction. The greater the mole fraction of B, the lower the remanence. If the mole fraction of B were less than 5.0 at %, the percentage of the main phase would decrease and soft magnetic compounds other than the main phase would be produced to decrease the coercivity of the magnet eventually. However, if the mole fraction of B were greater than 8.0 at %, the percentage of the main phase would also decrease and the resultant magnet would have decreased magnetization. For these reasons, the mole fraction of B preferably falls within the range of 5.0 at % to 8.0 at %. To obtain a high-performance magnet, the mole fraction of B is more preferably 5.5 at % through 7.0 at %

The transition metal T includes Fe as its main element and Mn as an essential element. In a magnetic alloy, Mn is present as a solid solution in the main phase as a matter of principle. If R=Nd, then the magnetization, anisotropic magnetic field and Curie temperature of the main phase would all decrease proportionally to the amount of Mn added and the performance of the magnet would decline. For that reason, in the prior art, Mn was included in as small an amount as possible. On the other hand, if R=Pr, then there would be a composition range in which the coercivity slightly increases and in which the amount of Mn added is small. And if R=Pr+Nd, then the problem of low coercivity at high temperatures, which would be produced when R=Pr, should be resolved.

FIG. 1 is a graph showing how the coercivity of an R-T-B based sintered magnet changed with the temperature in a situation where the mole fraction of Mn added was fixed at 0.01 at % and rare-earth elements were added in various combinations. In FIG. 1, the curve #1 represents the characteristic of Sample #1 in which R=Nd, and the (dashed) curve #4 represents the characteristic of Sample #4 in which R=Nd+Dy. It can be seen that if a portion of R=Nd was replaced with a heavy rare-earth element such as Dy, the coercivity increased in the entire temperature range shown in FIG. 1. On the other hand, curves #2 and #3 represent the characteristics of Samples #2 and #3 in which R=Pr+Nd. The coercivities of Samples #2 and #3 at room temperature were higher than that of the sample in which R=Nd according to the amount of Pr substituted. However, this tendency turned around at 80° C. or higher temperatures. That is to say, considering the application of the magnet at 80° C. or even higher temperatures, it would counteract the effects of the present invention to substitute Pr. Also, the intersection between the curve #1 and the curves #2 and #3 is not different between Samples #2 and #3, including different mole fractions of Mn, and was located at around 80° C.

Figure 2A:
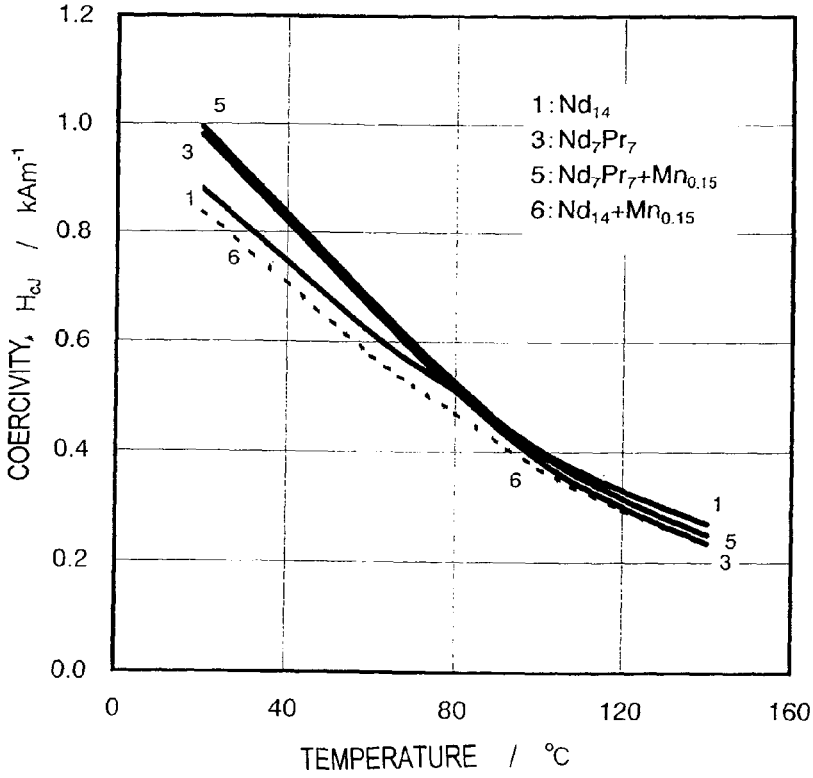
FIG. 2A is a graph showing how the variation in the coercivity of an R-T-B based sintered magnet with the temperature changed according to the amount of Mn added in a situation where R=Nd+Pr.
Figure 2B:
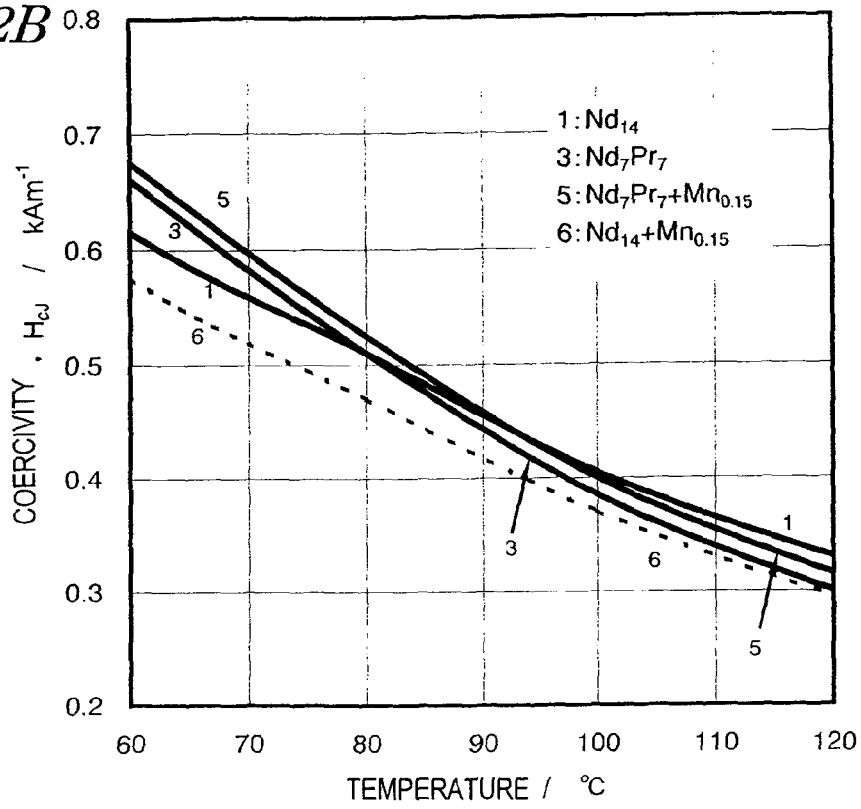
FIG. 2B is a partially enlarged one of the graph shown in FIG. 2A.

FIG. 2A is a graph schematically showing the effect of the additive Mn on the coercivity of a magnet, and FIG. 2B is a partially enlarged one of the graph shown in FIG. 2A. In FIGS. 2A and 2B, the curves #1 and #3 are the same as the ones shown in FIG. 1. The curve #5 represents the characteristic of Sample #5, in which the mole fraction of Mn of Sample #3 was changed into 0.15 at %. Sample #5, to which a very small amount of Mn was added, exhibited higher coercivity than Sample #3 in the entire temperature range. As a result, the coercivity became higher than that of Sample #1 at a higher temperature. The curve #6 represents the characteristic of Sample #6 that was obtained by adding Mn to a sample in which R=Nd. The coercivity decreased at any temperature.

If the mole fraction of Mn exceeded 0.3 at %, then the magnetization and coercivity would both decrease significantly. For that reason, the mole fraction of Mn is preferably 0.3 at % or less. More preferably, the mole fraction of Mn is less than 0.2 at % because coercivity that is equal to or higher than the one produced at room temperature by adding either no Mn at all or 0.01 at % or less of Mn would be achieved in that case.

Meanwhile, if the mole fraction of Mn were less than 0.02 at %, then the effect of the present invention would not manifest itself. That is why the lower limit of the preferred Mn mole fraction range is 0.02 at %.

It is not yet quite clear exactly how effectively Mn works in combination with Pr. But the mechanism could be understood in following two ways. One of the two possibilities is that if R=Pr, the anisotropic magnetic field of an $R_2Fe_{14}B$ compound could be increased by Pr at a particular mole fraction of Mn. This type of function was reported as to a situation where R=Y, for example. The other possibility is that whether it is present in the main phase or not, Mn would contribute to an interfacial reaction between the ferromagnetic main phase and the paramagnetic grain boundary phase, thus increasing the wettability or the degree of crystal matching. As this point in time, however, we are not confident enough to determine which of these two hypotheses is right or if there is any other factor.

The present inventors also discovered that even a very small amount of Mn added promoted the sintering reaction, which is another beneficial feature that contributes to producing a sintered magnet efficiently. Specifically, by adding Mn, the density of the magnet increased through the sintering reaction either at a lower temperature or in a shorter time. As a result, a sufficient sintered density could be achieved before the crystal grains grew too much. In addition, the magnet could have a further homogenized texture, and therefore, exhibited improved magnetic properties including improved loop squareness in its demagnetization curve.

To achieve the effect of improving the sintering behavior with the addition of Mn, the additive Mn should account for at least 0.02 at %, more preferably 0.05 at % or more.

The only cost-effective element that would achieve the effect of improving the sinterability seems to be Mn. This is probably because Mn should be the only element to enter substantially nowhere but in the main phase by solid solution among various useful elements. In the prior art, Al and Cu were considered elements that would improve the sinterability. However, these elements would achieve the effect of improving the physical properties of the grain boundary phase but would act only indirectly on the sintering reaction of the $R_2T_{14}B$ phase as the main phase. On the other hand, Mn will act directly on the sintering reaction of the main phase.

In an R-T-B based sintered magnet, a portion of Fe may sometimes be replaced with Co to improve the magnetic properties and the anticorrosiveness. In carrying out the present invention, the addition of Co would not counteract the effects of the present invention but would achieve some effects of increasing the Curie temperature and improving the anticorrosiveness. For that reason, Co is preferably added. If the mole fraction of Co added exceeded 20 at %, the magnetization would decrease significantly and the coercivity would drop steeply. That is why the upper limit of Co added is preferably 20 at %.

According to their functions and effects, the additive elements M can be classified into a first group consisting of Al, Ni, Cu, Zn, Ga, Ag, In, Sn and Bi and a second group consisting of Ti, V, Cr, Zr, Nb, Mo, Hf, Ta and W. An element in the first group is mainly present in the grain boundary in the metallurgical structure of the magnet and contributes to the interaction between the grain boundary and main phases. More specifically, the element will lower the melting point of the grain boundary phase to improve the sintering behavior of the magnet or increase the wettability between the main phase and the grain boundary phase, thereby expanding the grain boundary phase into the interface with the main phase more effectively and eventually increasing the coercivity of the magnet. Among these elements, the most effective ones are Al and Cu. On the other hand, any element in the second group will make the sintered structure finer and increase the coercivity by producing deposition with a high melting point, for example. No element in the first and second groups function as a ferromagnetic phase. For that reason, if a lot of such an element were added, the magnetization of the magnet would decrease. That is why the maximum mole fraction of these elements added is preferably 5 at % or less in total, more preferably 2 at % or less.

Other elements are not defined in the present invention and have nothing to do with the effect to be achieved by the present invention. However, the presence of those other elements is not necessarily ruled out according to the present invention. For example, hydrogen, carbon, nitrogen and oxygen are inevitably contained during the manufacturing process and are also detected when analyzed in specific examples of the present invention. Among other things, carbon and nitrogen may substitute for portions of B. In that case, however, the magnetic properties will be affected significantly (e.g., the coercivity of the magnet will decrease). In a normal sintered magnet, carbon and nitrogen will react with the rare-earth element just like oxygen to produce some carbide, nitride or oxide and be present in some form that does not affect the magnetic properties. Also, hydrogen and nitrogen are expected to enter sites of the main phase between its lattices and would increase the Curie temperature. However, this is not an effect to be achieved by the present invention. F, Cl, Mg, Ca and other elements may get included during the process step of refining a rare-earth metal or may also stay in the composition of the magnet as it is. P and S may be included in the Fe material. Also, Si and Al may not only come from a ferroboron alloy, which is a material source, but also get included as a crucible component while the material alloy to make the magnet is being melted.

Manufacturing Process

No matter what method is adopted to make the R-T-B based sintered magnet of the present invention, the effects of the present invention will be achieved equally. That is to say, the present invention is not limited to any specific manufacturing process. However, an exemplary manufacturing process that can be adopted will be described below.

Material Alloy

Material alloys may be prepared by any of various methods and used in any of various forms. Typical examples of preferred material alloys include an ingot alloy, a strip cast alloy, an atomized powder, a powder obtained by a reduction diffusion process and an alloy ribbon made by a rapid quenching process. Any of these material alloys may be used by itself. Or multiple material alloys of mutually different types may be used in combination as well. Still alternatively, a so-called "two-alloy process" that uses two alloys with different compositions in combination may also be adopted. In that case, in order to not only increase the coercivity but also improve the sinterability at high temperatures, Mn and Pr may be included in one or both of the two alloys. In the former case, Mn and Pr may be included in one of the two alloys, of which the main phase has a composition closer to that of the magnetic alloy. Furthermore, just to improve the sinterability, Mn and Pr could be introduced into two different alloys and mixed together. In that case, however, the coercivity could not be increased at high temperatures so much as expected.

Optionally, the mother alloy may be subjected to a heat treatment in order to improve the uniformity of its structure or the distribution of elements or increase its homogeneity, for example.

Pulverization

The pulverization process may also be carried out by any arbitrary method. An appropriate method is adopted according to the attribute of the start material. For example, if a strip cast alloy is used as a start material, the alloy often needs to go through the two pulverization process steps—a coarse pulverization process step and a fine pulverization process step. In that case, the coarse pulverization may be done by either a mechanical pulverization process or a hydrogen decrepitation process, which can be used effectively to pulverize a rare-earth alloy. As used herein, the "hydrogen decrepitation process" refers to a process in which a given alloy is enclosed along with hydrogen gas in a vessel, the hydrogen gas is absorbed into the alloy, and the alloy is pulverized by utilizing the strain to be caused by the variation in the volume of the alloy. According to this method, a lot of hydrogen will get included in the coarse powder. That is why the excessive hydrogen can be released by heating the coarse powder if necessary.

Optionally, after the alloy has been pulverized coarsely or before the coarse powder is subjected to the fine pulverization process step, the coarse powder may be classified with a sieve, for example, such that all of its particle sizes are equal to or smaller than a particular particle size.

The fine pulverization usually gets done by a jet milling process that uses a jet flow. Alternatively, a mechanical fine pulverization process or a wet ball milling process that uses a dispersion medium may also be adopted. Also, before the pulverization process is started, a pulverization assistant may be added in advance. This is particularly useful to increase the pulverization efficiency of the fine pulverization process step.

As for how to handle the material alloy or the coarse powder, it is important to handle them in an inert atmosphere to make a high-performance magnet. As far as it is handled at ordinary temperatures, it should be enough if the inert atmosphere is nitrogen gas. However, if a heat treatment should be conducted at 300° C. or even higher temperatures, helium gas or argon gas needs to be used as the inert atmosphere.

The objective particle size of the pulverized powder is determined by the intended performance of the magnet and various restrictions to be imposed in the next compaction process step. Normally, the objective particle size may be a D50 particle size of 3 μm to 7 μm according to the laser diffraction analysis using the gas dispersion technique. This particle size falls within such a particle size range that is easily achieved by a jet milling process. The particle sizes of the fine powder are supposed to be measured by the gas dispersion process because the fine powder is a ferromagnetic that easily aggregates magnetically.

Compaction

To make an anisotropic sintered magnet, the fine powder is compacted under a magnetic field and magnetic anisotropy is given to the magnet. In general, the fine powder obtained by the pulverization process is loaded into the die holes of a press machine, a cavity is formed by upper and lower punches with a magnetic field applied externally, and the fine powder is pressed and compacted with the punches and then unloaded. In this process, a lubricant may be added to the fine material powder to increase the degree of alignment with the magnetic field applied or to increase the lubricity of the die. The lubricant may be a solid one or a liquid one, which may be determined with various factors into consideration. Optionally, the fine powder may be granulated appropriately to be loaded into the die holes more easily, for example.

Also, as the aligning magnetic field, not only a static magnetic field generated by a DC power supply but also a pulse magnetic field generated by discharge of a capacitor or an AC magnetic field may be used as well.

If the composition of the present invention is adopted, the magnetic field applied preferably has a strength of 0.4 MA/m or more usually, and more preferably has a strength of 0.8 MA/m or more. After the compaction process, reverse magnetic field may be applied to perform a demagnetizing process. By performing such a demagnetizing process, the compact can be handled more easily after that because the compact will have no remnant magnetization.

Optionally, if the directions of applying the magnetic field during the compaction process are changed according to a special pattern, a magnet with any of various aligned states can be made. As for ring magnets, for example, the magnets may not only be axially aligned but also radially aligned or anisotropically aligned so as to have multiple magnetic poles.

The compaction process does not have to be performed using the die and punches as described above. Alternatively, the compaction process may also be performed using a rubber mold. Optionally, the compaction and the application of the magnetic field may be performed separately.

Sintering

The sintering process is carried out in either a vacuum or an argon gas atmosphere. The pressure and other parameters of the atmosphere may be determined arbitrarily. Optionally, the sintering process may be carried out in a helium gas atmosphere. However, the thermal efficiency of the sintering furnace could decrease due to the good heat conduction of the helium gas.

The sintering process is usually carried out at a temperature of 1,000° C. to 1,100° C. for 30 minutes to 16 hours. In the composition range of the present invention, the sintering process causes a liquid phase in the compact of the present invention, and therefore, the temperature does not have to be so high. If necessary, a number of sintering processes may be performed either at the same temperature or multiple different temperatures. As for the cooling process after the temperature has been held, it is not always necessary to perform a rapid cooling process or a gradual cooling process. Alternatively, various conditions (including those of the heat treatment process to be described below) may be combined appropriately.

After the sintering process, the magnet of the present invention can have a specific gravity of at least 7.3, more preferably 7.4 or more.

Optionally, any other sintering means for use in a powder metallurgical process, such as a hot press in which the object is heated while being subjected to an external pressure or an electro-sintering process in which a given compact is supplied with electricity and heated with Joule heat, may also be adopted. If any of those alternative means is adopted, the sintering temperature and process time do not have to be as described above.

Heat Treatment

To increase the coercivity, the sintered body may be subjected to some heat treatment at a temperature that is equal to or lower than the sintering temperature. Optionally, the heat treatment may be conducted a number of times at either the same temperature or multiple different temperatures. In performing the heat treatment, various conditions may be set for the cooling process.

It should be noted that if the as-sintered body already has sufficient coercivity, there is no need to subject it to any heat treatment.

Machining

The sintered body sometimes has a shape that is close to its final one, but in most cases, is subjected to some machining process such as cutting, polishing or grinding to have its shape finished into a predetermined one. As long as it is done after the sintering process, this machining process may be carried out either before or after the heat treatment process or between multiple heat treatment processes.

Surface Treatment

In a normal environment, a sintered magnet with a composition according to the present invention would rust in the long run. That is why the magnet should be subjected to some surface coating treatment appropriately. Examples of preferred surface treatments include resin coating, metal plating, and vapor deposition of a film. Among these various surface treatments, an appropriate one is selected with the application, required performance and cost taken into consideration.

Magnetization

A magnet according to the present invention is usually magnetized with a pulse magnetic field. This magnetization process is often carried out after the magnet has been built in the product for the convenience of the assembling process. However, it is naturally possible to magnetize the magnet by itself and then build the magnet into the product.

The magnetizing direction needs to be determined with the aligning direction for the compaction process under the magnetic field taken into consideration. Usually a high-performance magnet cannot be obtained unless these two directions agree with each other. Depending on the application, however, the aligning direction for the compaction process does not have to agree with the magnetizing direction.

EXAMPLES

Example 1

An alloy with an objective composition was prepared by mixing together Pr and Nd with a purity of 99.5% or more, Tb and Dy with a purity of 99.9% or more, electrolytic iron, and low-carbon ferroboron alloy together with the other objective elements added in the form of pure metals. The alloy was then melted and cast by a strip casting process, thereby obtaining a plate-like alloy with a thickness of 0.3 mm to 0.4 mm.

This material alloy was subjected to a hydrogen decrepitation process within a hydrogen atmosphere with an increased pressure, heated to 600° C. in a vacuum, cooled and then classified with a sieve, thereby obtaining a coarse alloy powder with a particle size of 425 μm or less. Then, zinc stearate was added to, and mixed with, this coarse powder so as to account for 0.05 mass % of the powder.

Next, the coarse alloy powder was subjected to a dry pulverization process using a jet mill machine in a nitrogen gas flow, thereby obtaining a fine powder with a particle size D50 of 4 μm to 5 μm. In this process, as for a sample that should have an objective content of oxygen, the concentration of oxygen in the pulverization gas was controlled to 50 ppm or less. This particle size was obtained by the laser diffraction analysis using the gas dispersion technique.

The fine powder thus obtained was compacted under a magnetic field to make green compacts. In this process, a static magnetic field of approximately 0.8 MA/m and a compacting pressure of 98 MPa were applied. It should be noted that the direction in which the magnetic field was applied and the direction in which the compacting pressure was applied were orthogonal to each other. Also, as for a sample that should have the objective oxygen content, the sample was transported from the pulverizer into the sintering furnace so as to be kept in a nitrogen atmosphere for as much of the time as possible.

Next, those green compacts were sintered at a temperature of 1,020° C. to 1,080° C. for two hours in a vacuum. The sintering temperature varied according to the composition. In any case, the sintering process was carried out at as low a temperature as possible as far as the sintered compacts could have a density of 7.5 $Mg/m^3$.

The compositions of the sintered bodies thus obtained were analyzed as shown in FIG. 4. And the results shown in FIG. 4 were converted into the atomic percentages shown in FIG. 5. The analysis was carried out using an ICP. However, the contents of oxygen, nitrogen and carbon were obtained with a gas analyzer. Each of these samples was subjected to a hydrogen analysis by a dissolution technique. As a result, the contents of hydrogen in those samples were in the range of 10 ppm to 20 ppm.

In addition to the elements shown in the table, not only hydrogen but also Si, Ca, Cr, La, Ce and other elements could be detected. In most cases, Si would come from the crucible along with Al while the ferroboron material and the alloy were being melted, and Ca, La and Ce would come from the rare-earth material. And Mn and Cr could be included in iron. It is impossible to reduce all of these impurities to absolutely zero. For example, although Sample #1 was supposed to include no Al at all, actually Al was sill detected from that sample.

The sintered bodies thus obtained were thermally treated at various temperatures for an hour within an Ar atmosphere and then cooled. The heat treatment was conducted with the temperatures changed according to the composition. Also, some samples were subjected to the heat treatment up to three times with the temperatures changed. After those samples were machined, their magnetic properties were measured at room temperature with a B—H tracer. The magnetic properties of the same samples were measured again at 140° C. The results are shown in the following Table 1:

TABLE 1

| | $B_r$/T | $H_{cJ}$/$MAm^{-1}$ | |
|---|---|---|---|
| No. | 20° C. | 20° C. | 140° C. |
| 1 | 1.380 | 0.853 | 0.240 |
| 2 | 1.392 | 0.954 | 0.271 |
| 3 | 1.394 | 0.988 | 0.281 |
| 4 | 1.391 | 1.006 | 0.285 |
| 5 | 1.388 | 0.992 | 0.291 |
| 6 | 1.410 | 0.998 | 0.294 |
| 7 | 1.424 | 1.016 | 0.314 |
| 8 | 1.402 | 0.996 | 0.298 |
| 9 | 1.274 | 1.684 | 0.584 |
| 10 | 1.268 | 1.683 | 0.584 |
| 11 | 1.374 | 1.251 | 0.411 |
| 12 | 1.280 | 1.712 | 0.632 |
| 13 | 1.372 | 0.827 | 0.226 |
| 14 | 1.394 | 0.992 | 0.274 |
| 15 | 1.389 | 0.975 | 0.274 |
| 16 | 1.278 | 1.655 | 0.552 |
| 17 | 1.376 | 1.230 | 0.392 |
| 18 | 1.282 | 1.683 | 0.607 |
| 19 | 1.410 | 0.880 | 0.248 |
| 20 | 1.398 | 0.956 | 0.228 |

It should be noted that among the samples that had been thermally treated under various conditions, those exhibiting the highest coercivity at room temperature were used as objects of evaluation.

Sample #8 represents a comparative example including more than 0.21 at % of Mn and had lower remanence $B_r$ than Sample #7 having a similar composition except for the content of Mn. Samples #13 through #18 represent comparative examples including less than 0.02 at % of Mn and had lower coercivity at 140° C. than Samples #1 through #7 and Samples #9 through #12 of the present invention to which both Pr and Mn were added.

Samples #19 and #20 also represent comparative examples to which either Pr or Nd was added as a rare-earth element. Compared to Sample #4 representing a specific example of the present invention (although the contents of the other elements are not equal to each other between these two samples), Sample #19 had lower coercivity at room temperature and Sample #20 had lower coercivity at 140° C.

Example 2

Figure 3:
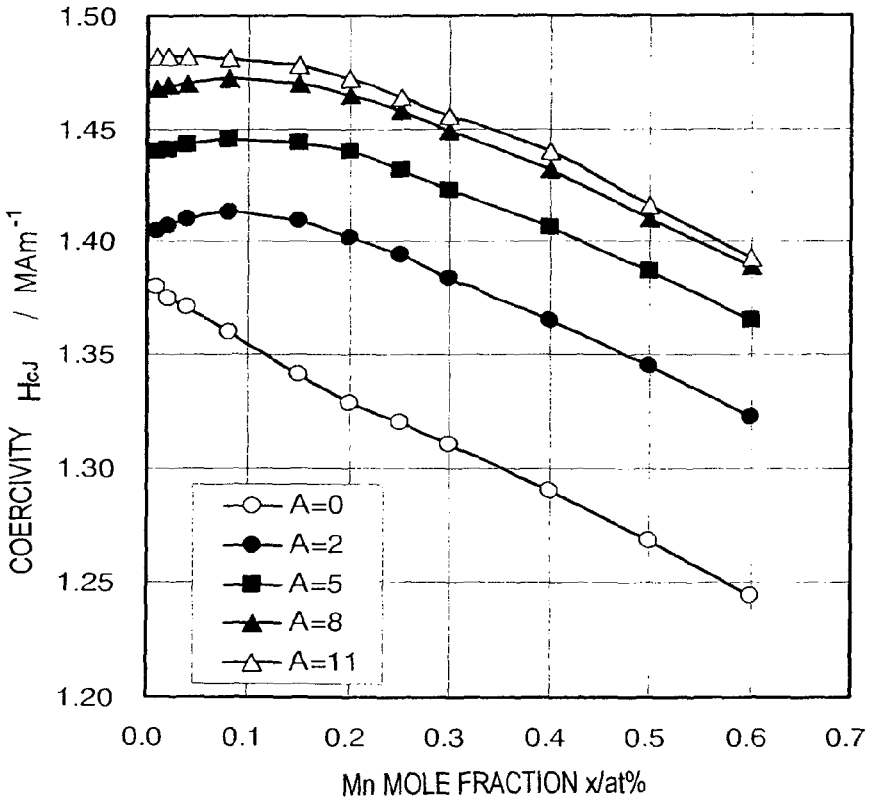
FIG. 3 is a graph showing how the coercivity of an Nd—Pr—Dy—Fe—Co—Al—Cu—Mn—B sintered magnet at room temperature changed with the mole fraction x of Mn added.

Magnets, of which the compositions were represented by $Nd_{13.5-A}Pr_ADy_{1.0}Fe_{bal.}Co_{2.0}Al_{0.5}Cu_{0.1}Mn_xB_{6.0}$ (where subscripts are atomic percentages), had their coercivity measured at room temperature with the mole fraction A of Pr set to be 0, 2, 5, 8 and 11 (at %) and with the mole fraction x of Mn varied. The results are shown in FIG. 3. The magnets of this Example 2 were produced by the same method as that adopted for Example 1.

As can be seen from FIG. 3, in a situation where A=0, as Mn was added, the coercivity decreased monotonically. On the other hand, if a portion of the rare-earth element was replaced with Pr, the coercivity rather increased as long as the amount of Mn added fell within a particular range.

However, in a situation where the mole fraction A of Pr was 11 at %, the coercivity did not increase appreciably even if Mn was added.

Example 3

Sintered magnets, of which the compositions were represented by $Nd_{11.5}Pr_{1.0}Dy_{1.2}Fe_{bal.}Cu_{0.1}Mn_xB_{6.0}$ (where subscripts are atomic percentages), were made with the mole fraction x varied and had their magnetic properties measured. The results are shown in the following Table 2:

TABLE 2

| | Mole fraction | Density | Magnetic properties | | |
|---|---|---|---|---|---|
| No. | x of Mn (at %) | $\rho$/MGm$^{-3}$ | $J_r$/T | $H_{cJ}$/kAm$^{-1}$ | $H_k/H_{cJ}$ |
| 21 | 0.01 | 7.34 | 1.337 | 1026 | 0.926 |
| 22 | 0.02 | 7.49 | 1.368 | 1122 | 0.971 |
| 23 | 0.05 | 7.51 | 1.372 | 1155 | 0.989 |
| 24 | 0.10 | 7.54 | 1.376 | 1134 | 0.987 |
| 25 | 0.15 | 7.53 | 1.372 | 1119 | 0.987 |
| 26 | 0.20 | 7.54 | 1.368 | 1105 | 0.988 |
| 27 | 0.25 | 7.54 | 1.363 | 1091 | 0.987 |
| 28 | 0.30 | 7.53 | 1.360 | 1074 | 0.988 |
| 29 | 0.40 | 7.54 | 1.351 | 1040 | 0.985 |
| 30 | 0.50 | 7.54 | 1.343 | 1008 | 0.988 |
| 31 | 0.60 | 7.54 | 1.335 | 981 | 0.983 |
| 32 | 0.80 | 7.53 | 1.316 | 908 | 0.978 |

The same manufacturing process as that adopted for Example 1 was also carried out. Every magnet with any of these compositions was sintered at 1,020° C. for two hours. The magnetic properties were evaluated by calculating $H_k$ as an index and figuring out $H_k/H_{cJ}$ as an index to loop squareness. In this case, $H_k$ represents a value of a demagnetization field when the value of magnetization becomes 90% of $J_r$. The closer to one the $H_k/H_{cJ}$ ratio is, the better the loop squareness and the more useful the given magnet should be.

As can be seen from Table 2, if the mole fraction of Mn added was equal to or greater than 0.02 at %, the density of the magnet increased compared to a magnet that was sintered under the same condition. As a result, the remanence $J_r$ and the loop squareness $H_k/H_{cJ}$ of the demagnetization curve improved. However, if the mole fraction of Mn exceeded 0.50 at %, the magnetization of the main phase decreased with the addition of Mn. Consequently, the remanence $J_r$ was lower than that of Sample #21 including 0.01 at % of Mn. A preferred composition range for Mn in which good magnetic properties were realized was 0.02 at % through 0.30 at %.

According to the results of a gas analysis, 0.44 mass % to 0.49 mass % of oxygen, 0.035 mass % to 0.043 mass % of carbon, 0.010 mass % to 0.014 mass % of nitrogen, and less than 0.002 mass % of hydrogen were included as inevitable impurities in the sintered magnets. Also, according to the results of the ICP analysis, at most 0.04 mass % of Si and 0.01 mass % or less of Cr, Ce, Ca, etc. was detected.

Example 4

Sintered magnets with various compositions were obtained by the same method as that adopted for Example 1. The mole fraction of Mn added was fixed at 0.06 at %. As the additive elements M, Al, Cu and Ga were selected from the first group and Mo was selected from the second group. And the amounts of rare-earth elements, B and additive elements M were changed into various values (including zero). The compositions (analyzed values) of the magnets thus obtained are shown in the following Table 3 and their magnetic properties are shown in the following Table 4:

TABLE 3

| | Chemical symbols | | | | | | | | | | | | |
|---|---|---|---|---|---|---|---|---|---|---|---|---|---|
| No. | Nd | Pr | Tb | Dy | Fe | Co | Mn | Al | Cu | Ga | Mo | B | O |
| 33 | 11.0 | 1.0 | | | 81.5 | | 0.06 | 0.04 | 0.10 | | | 5.83 | 0.51 |
| 34 | 12.0 | 0.5 | | | 80.8 | | 0.06 | 0.04 | 0.10 | | | 5.86 | 0.68 |
| 35 | 12.0 | 3.0 | | | 76.7 | | 0.06 | 0.04 | 0.10 | | | 6.06 | 2.05 |
| 36 | 7.0 | 10.0 | | | 74.5 | | 0.06 | 0.04 | 0.10 | | | 5.97 | 2.31 |
| 37 | 12.8 | 4.2 | | | 75.2 | | 0.06 | 0.04 | 0.10 | | | 5.06 | 2.49 |
| 38 | 7.0 | 7.0 | | | 77.9 | | 0.06 | 0.04 | 0.10 | 0.05 | | 5.51 | 2.34 |
| 39 | 13.0 | 0.2 | | | 77.8 | | 0.06 | 0.04 | 0.10 | 0.05 | | 7.00 | 1.79 |
| 40 | 12.0 | 2.0 | | | 76.0 | | 0.06 | 0.04 | 0.10 | | | 7.98 | 1.80 |
| 41 | 9.0 | 3.5 | | 1.30 | 78.0 | | 0.06 | 0.24 | 0.10 | | | 5.98 | 1.78 |
| 42 | 5.2 | 7.0 | | 1.60 | 72.5 | 3.00 | 0.06 | 0.04 | 0.10 | | 1.50 | 7.00 | 1.96 |
| 43 | 12.0 | 0.2 | | 1.60 | 66.4 | 5.00 | 0.06 | 0.48 | 0.10 | | 4.00 | 8.00 | 2.11 |
| 44 | 9.0 | 3.4 | | 1.30 | 72.8 | 5.30 | 0.06 | 0.24 | 0.10 | 0.05 | | 5.91 | 1.86 |
| 45 | 9.1 | 3.5 | | 1.30 | 68.2 | 9.50 | 0.06 | 0.24 | 0.10 | 0.05 | | 5.92 | 1.98 |
| 46 | 9.1 | 3.4 | | 1.30 | 58.0 | 20.00 | 0.06 | 0.24 | 0.10 | | | 5.97 | 1.86 |
| 47 | 3.6 | 8.0 | | 2.10 | 75.7 | 2.10 | 0.06 | 0.48 | | | | 5.97 | 1.94 |
| 48 | 8.2 | 1.0 | | 4.50 | 75.8 | 2.10 | 0.06 | 0.48 | | 0.05 | | 5.85 | 1.93 |
| 49 | 12.5 | 0.5 | 0.25 | 0.55 | 75.7 | 2.10 | 0.06 | 0.48 | | | | 5.92 | 1.94 |
| 50 | 12.7 | 0.5 | 0.60 | | 75.8 | 2.10 | 0.06 | 0.48 | | | | 5.92 | 1.82 |

TABLE 4

| | Magnetic properties | |
|---|---|---|
| No. | $J_r$/T | $H_{cJ}$/kAm$^{-1}$ |
| 33 | 1.457 | 712 |
| 34 | 1.459 | 705 |
| 35 | 1.351 | 885 |
| 36 | 1.275 | 912 |
| 37 | 1.206 | 622 |
| 38 | 1.349 | 770 |
| 39 | 1.401 | 916 |
| 40 | 1.332 | 971 |
| 41 | 1.377 | 1325 |
| 42 | 1.295 | 1726 |

TABLE 4-continued

| No. | Magnetic properties | |
|---|---|---|
| | $J_r$/T | $H_{cJ}$/kAm$^{-1}$ |
| 43 | 1.167 | 2058 |
| 44 | 1.378 | 1312 |
| 45 | 1.372 | 1343 |
| 46 | 1.376 | 1308 |
| 47 | 1.311 | 1563 |
| 48 | 1.203 | 2314 |
| 49 | 1.384 | 1286 |
| 50 | 1.382 | 1298 |

With any of these compositions, the effects of the present invention were achieved.

According to the results of a gas analysis, 0.032 mass % to 0.057 mass % of carbon, 0.010 mass % to 0.027 mass % of nitrogen, and less than 0.002 mass % of hydrogen were included as inevitable impurities in the sintered magnets. Also, according to the results of the ICP analysis, at most 0.05 mass % of Si and 0.01 mass % or less of Cr, Ce, Ca, etc. was detected.

A sintered magnet according to the present invention can be used extensively in various applications that require high-performance sintered magnets.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. An R-T-B based sintered magnet having a composition comprising:

12 at % to 15 at % of a rare-earth element R;

5.0 at % to 8.0 at % of boron B;

0.02 at % to less than 0.2 at % of Mn; and a transition metal T as the balance; wherein the rare-earth element R is at least one element selected from the group of elements consisting of the rare-earth elements and Y and includes at least Nd and Pr, where the content of Pr being 0.2 at % to 8 at % of the sintered magnet; and the transition metal T includes Fe as its main element.

2. The R-T-B based sintered magnet of claim 1, wherein the rare-earth element R includes at least one of Tb and Dy in addition to Nd and Pr.

3. The R-T-B based sintered magnet of claim 1, wherein the magnet includes 20 at % or less of Co as the transition metal T.

4. An R-T-M-B based sintered magnet having a composition comprising:

12 at % to 15 at % of a rare-earth element R;

5.0 at % to 8.0 at % of boron B;

0.02 at % to less than 0.2 at % of Mn;

more than 0 at % to 5.0 at % of an additive element M; and a transition metal T as the balance; wherein the rare-earth element R is at least one element selected from the group of elements consisting of the rare-earth elements and Y and includes at least Nd and Pr, where the content of Pr being 0.2 at % to 8 at % of the sintered magnet;

the transition metal T includes Fe as its main element; and the additive element M is at least one element selected from the group consisting of Al, Ni, Cu, Zn, Ga, Ag, In, Sn, Bi, Ti, V, Cr, Zr, Nb, Mo, Hf, Ta and W.

5. The R-T-M-B based sintered magnet of claim 4, wherein the rare-earth element R includes at least one of Tb and Dy in addition to Nd and Pr.

6. The R-T-M-B based sintered magnet of claim 4, wherein the magnet includes 20 at % or less of Co as the transition metal T.

* * * * *